US007932675B2

(12) United States Patent
Kawase et al.

(10) Patent No.: US 7,932,675 B2
(45) Date of Patent: Apr. 26, 2011

(54) PLASMA DISPLAY PANEL

(75) Inventors: Akira Kawase, Osaka (JP); Kazuhiro Morioka, Kyoto (JP); Eiichi Uriu, Osaka (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 281 days.

(21) Appl. No.: 11/814,293

(22) PCT Filed: Feb. 6, 2007

(86) PCT No.: PCT/JP2007/052020

§ 371 (c)(1),
(2), (4) Date: Jul. 19, 2007

(87) PCT Pub. No.: WO2007/094202

PCT Pub. Date: Aug. 23, 2007

(65) Prior Publication Data

US 2010/0156292 A1 Jun. 24, 2010

(30) Foreign Application Priority Data

Feb. 14, 2006 (JP) ..... 2006-036346

(51) Int. Cl.
*H01J 17/49* (2006.01)

(52) U.S. Cl. ..... 313/586; 313/587

(58) Field of Classification Search ..... 313/582–587
See application file for complete search history.

(56) References Cited

U.S. PATENT DOCUMENTS

| | | | | |
|---|---|---|---|---|
| 6,517,400 | B1 * | 2/2003 | Cho et al. | 445/24 |
| 6,897,610 | B1 | 5/2005 | Aoki et al. | |
| 2002/0036466 | A1 | 3/2002 | Tanaka et al. | |
| 2005/0113241 | A1 | 5/2005 | Yamamoto et al. | |
| 2006/0125398 | A1 * | 6/2006 | Ahn | 313/583 |

FOREIGN PATENT DOCUMENTS

| | | |
|---|---|---|
| JP | 09-050769 | 2/1997 |
| JP | 2001-195989 | 7/2001 |
| JP | 2001-195989 A | 7/2001 |
| JP | 2001-266753 | 9/2001 |
| JP | 2002-025341 | 1/2002 |

(Continued)

OTHER PUBLICATIONS

Search Report dated Feb. 28, 2008.

(Continued)

*Primary Examiner* — Bumsuk Won
(74) *Attorney, Agent, or Firm* — Pearne & Gordon LLP

(57) ABSTRACT

There is provided a plasma display panel including: a front plate having display electrodes, a dielectric layer, and a protective layer formed on a glass substrate; and a rear plate that has electrodes, barrier ribs, and a phosphor layer formed on a substrate and is disposed opposite to the front plate. Peripheries of the front plate and the rear plate are sealed to form a discharge space, the display electrodes contains at least silver, the dielectric layer is configured to include a first dielectric layer that covers the display electrodes and second dielectric layer that covers the first dielectric layer and contains bismuth oxide, the thickness of the first dielectric layer is equal to or larger than 5 μm and equal to or smaller than 13 μm, and the ratio of the thickness of the first dielectric layer to the thickness of the display electrodes is larger than 1 and equal to or smaller than 3.

7 Claims, 2 Drawing Sheets

FOREIGN PATENT DOCUMENTS

| | | |
|---|---|---|
| JP | 2002-053342 | 2/2002 |
| JP | 2003-115261 | 4/2003 |
| JP | 2003-128430 | 5/2003 |
| JP | 2003-162962 | 6/2003 |
| JP | 2003-192376 | 7/2003 |
| JP | 2004-327456 | 11/2004 |
| JP | 2004-345913 | 12/2004 |
| JP | 2005-231923 | 9/2005 |
| KR | 10-2005-0043711 A | 5/2005 |

OTHER PUBLICATIONS

South Korean Office Action.

* cited by examiner

PLASMA DISPLAY PANEL

TECHNICAL FIELD

The present invention relates to a plasma display panel used in a display device and the like.

BACKGROUND ART

As high resolution and large screen in a plasma display panel (hereinafter, referred to as 'PDP') are realized, a 65-inch television and the like are produced commercially. In recent years, application of a PDP to full spec Hi-Vision, in which the number of scan lines is twice or more than that in the known NTSC system, is under progress and a PDP not containing lead is requested in consideration of an environmental issue.

Basically, a PDP is configured to include a front plate and a rear plate. The front panel is configured to include a glass substrate made of sodium borosilicate based glass using a float method, display electrodes including strip-shaped transparent electrodes and bus electrodes formed on a main surface of the glass substrate, a dielectric layer that covers the display electrodes and serves as a capacitor, and a protective layer that is formed on the dielectric layer and made of magnesium oxide (MgO). On the other hand, the rear plate is configured to include a glass substrate, strip-shaped address electrodes formed on a main surface of the glass substrate, a base dielectric layer that covers the address electrodes, barrier ribs formed on the base dielectric layer, and a phosphor layer that is formed between the barrier ribs to emit light in red, green, and blue colors.

The front plate and the rear plate are airtight sealed such that surfaces, on which electrodes are formed, of the front plate and the rear plate are disposed opposite to each other. Discharge gas of Ne—Xe is filled into a discharge space divided by barrier ribs at the pressure of 53200 Pa to 79800 Pa. In the PDP, electrical discharge occurs by selectively applying a video signal voltage to a display electrode and ultraviolet rays generated by the discharge excite each color phosphor layer to emit red, green, and blue colored light, and thus color image display is realized.

A silver electrode is used as the metal bus electrode of the display electrode in order to secure the conductivity and a low-melting-point glass material having lead oxide as a main component is used for the dielectric layer. However, in consideration of an environmental issue in recent years, an example not containing a lead component as the dielectric layer is disclosed (for example, refer to Patent Documents 1, 2, and 3).

Moreover, in recent years, application of a PDP to full spec Hi-Vision, in which the number of scan lines is twice or more than that in the known NTSC system, is under progress. Due to such application to Hi-Vision, the number of scan lines increases, and accordingly, the number of display electrodes increases. As a result, a distance between display electrodes becomes further reduced.

For this reason, silver ions are more diffused from silver electrodes, which form display electrodes, to a dielectric layer. If silver ions are diffused into the dielectric layer, the silver ions are reduced by alkali metal ions contained in the dielectric layer, thereby forming colloidal silver oxide. Due to the silver oxide, the dielectric layer is strongly colored in yellow or brown. In addition, a part of the silver oxide is reduced to generate oxygen bubbles, and the bubbles cause poor insulation.

Therefore, it has been proposed to use a low-melting-point glass material such as bismuth oxide, which serves to inhibit reaction with a silver electrode, for the dielectric layer without allowing a lead component to be contained in the dielectric layer; however, it has been difficult to properly set the thickness of the dielectric layer, which uses the low-melting-point glass material such as bismuth oxide, with respect to the thickness of the display electrode having the silver electrode. That is, if the thickness of the dielectric layer is smaller than the thickness of the display electrode, the low-melting-point glass material such as bismuth oxide is smaller than the silver electrode, and accordingly, an effect of inhibiting reaction with the silver electrode is reduced. In contrast , if the thickness of the dielectric layer is larger than the thickness of the display electrode, the low-melting-point glass material such as bismuth oxide serves to inhibit the reaction with the silver electrode, but it is difficult that bubbles generated due to generated silver oxide escape from the dielectric layer, resulting in a cause of poor insulation.

Thus, in the known dielectric layer not containing a lead component, which has been suggested in consideration of the environmental issue, it has been difficult to properly set the thickness of the dielectric layer with respect to the thickness of the display electrode.

[Patent Document 1] Japanese Patent Unexamined Publication No. 2003-128430

[Patent Document 2] Japanese Patent Unexamined Publication No. 2002-053342

[Patent Document 3] Japanese Patent Unexamined Publication No. 9-050769

DISCLOSURE OF THE INVENTION

According to an aspect of the invention, there is provided a plasma display panel including: a front plate having display electrodes, a dielectric layer, and a protective layer formed on a glass substrate; and a rear plate that has electrodes, barrier ribs, and a phosphor layer formed on a substrate and is disposed opposite to the front plate. Peripheries of the front plate and the rear plate are sealed to form a discharge space, the display electrodes contains at least silver, the dielectric layer is configured to include a first dielectric layer that covers the display electrodes and second dielectric layer that covers the first dielectric layer and contains bismuth oxide, the thickness of the first dielectric layer is equal to or larger than 5 μm and equal to or smaller than 13 μm, and the ratio of the thickness of the first dielectric layer to the thickness of the display electrodes is larger than 1 and equal to or smaller than 3.

If the ratio of the thickness of the first dielectric layer, which contains bismuth oxide in order to inhibit reaction with silver, to the thickness of the display electrodes containing a silver exceeds 3, it is difficult that bubbles generated due to silver oxide escape from the dielectric layer, resulting in a cause of poor insulation. Therefore, by setting the ratio of the thickness of the first dielectric layer to the thickness of the display electrodes within the range described above, it is possible to realize a PDP with a dielectric layer not containing a lead component, in which generation of bubbles can be reduced by inhibiting reaction with silver electrodes and generated bubbles easily escape from the dielectric layer such that poor insulation does not occur even in high-resolution display.

DESCRIPTION OF REFERENCE NUMERALS AND SIGNS

Figure 1:
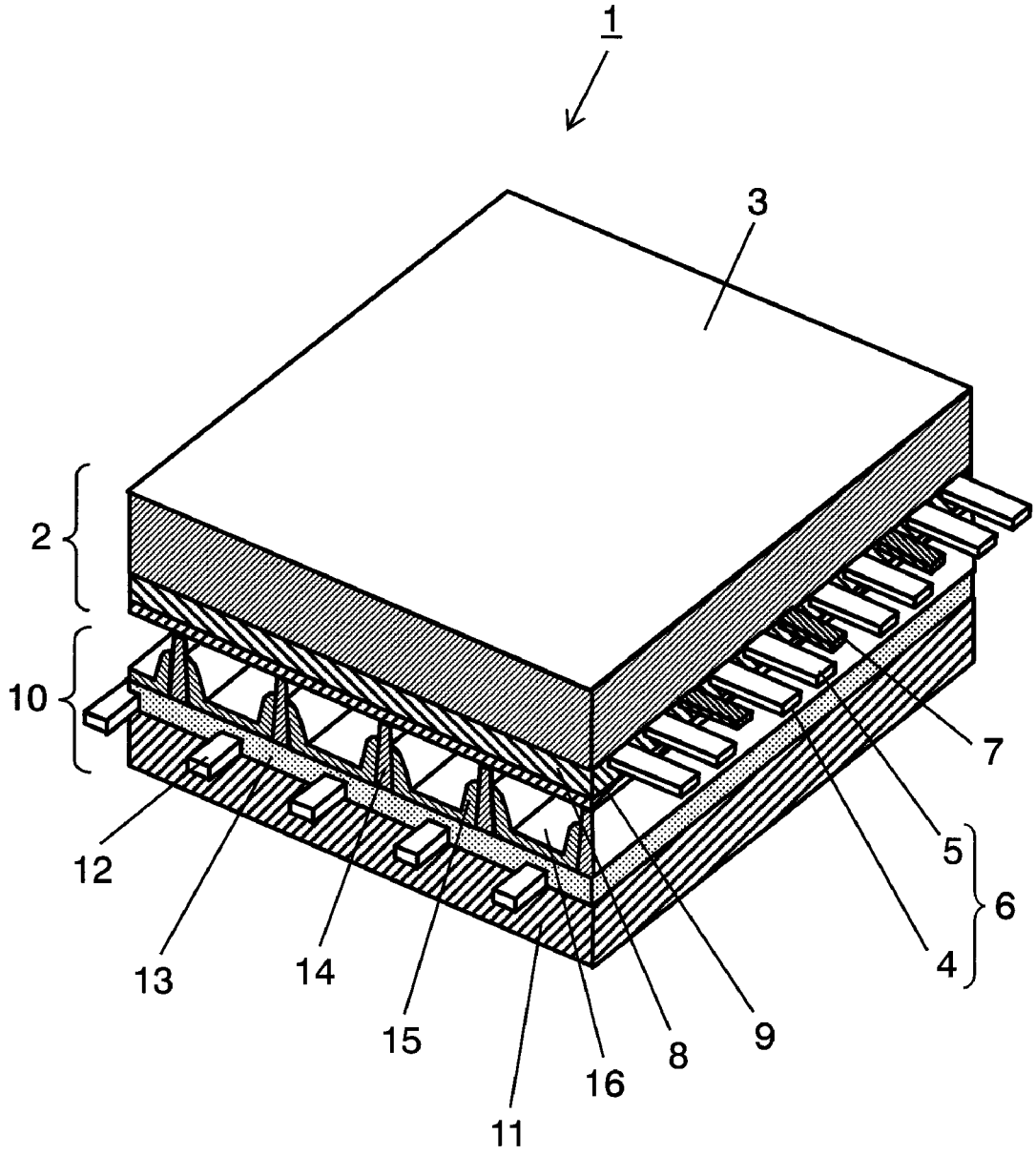
FIG. 1 a perspective view illustrating the structure of a PDP according to an embodiment of the invention.

1: PDP
2: front plate
3: front glass substrate (glass substrate)
4: scan electrode
4*a*, 5*a*: transparent electrode
4*b*, 5*b*: metal bus electrode
5: sustain electrode
6: display electrode
7: black stripe (light shielding layer)
8: dielectric layer
9: protective layer
10: rear plate
11: rear glass substrate (substrate)
12: address electrode (electrode)
13: base dielectric layer
14: barrier rib
15: phosphor layer
16: discharge space
81: first dielectric layer
82: second dielectric layer

PREFERRED EMBODIMENTS FOR CARRYING OUT THE INVENTION

Hereinafter, a PDP according to an embodiment of the invention will be described with reference to the accompanying drawings.

FIG. 1 is a perspective view illustrating the structure of a PDP according to an embodiment of the invention. The basic structure of the PDP is the same as that of a general alternating-current surface discharge type PDP. As shown in FIG. 1, in PDP 1, front plate 2 having front glass substrate (glass substrate) 3 and the like and rear plate 10 having rear glass substrate (substrate) 11 and the like are disposed opposite to each other and outer peripheries of front plate 2 and rear plate 10 are airtight sealed by sealant, such as glass frit. In discharge space 16 inside sealed PDP 1, discharge gas, such as neon (Ne) and xenon (Xe), is filled at a pressure of 53200 Pa to 79800 Pa.

On front glass substrate 3 of front plate 2, a plurality of strip-shaped display electrodes 6, each of which includes a pair of scan electrode 4 and sustain electrode 5, and a plurality of black stripes (light shielding layer) 7 are disposed parallel to each other. On front glass substrate 3, dielectric layer 8 serving as a capacitor is formed to cover display electrodes 6 and shielding layer 7 and then protective layer 9 made of , for example, magnesium oxide (MgO) is formed on dielectric layer 8.

Further, on rear glass substrate 11 of rear plate 10, a plurality of strip-shaped address electrodes 12 are disposed parallel to each other in the direction perpendicular to scan electrodes 4 and sustain electrodes 5 of front plate 2, and then base dielectric layer 13 covers address electrodes 12. Moreover, on base dielectric layer 13 between address electrodes 12, barrier ribs 14 that have a predetermined height and serve to divide discharge space 16 are formed. Phosphor layers 15 that emit red, blue, and green colored light by ultraviolet rays, respectively, are sequentially applied and formed on grooves between barrier ribs 14 for every address electrode 12. Discharge cells are formed at the positions where scan electrode 4, sustain electrodes 5, and address electrodes 12 intersect. Discharge cells having red, blue, and green colored phosphor layers 15 disposed to be parallel in the direction of display electrode 6 become pixels for color display.

Figure 2:
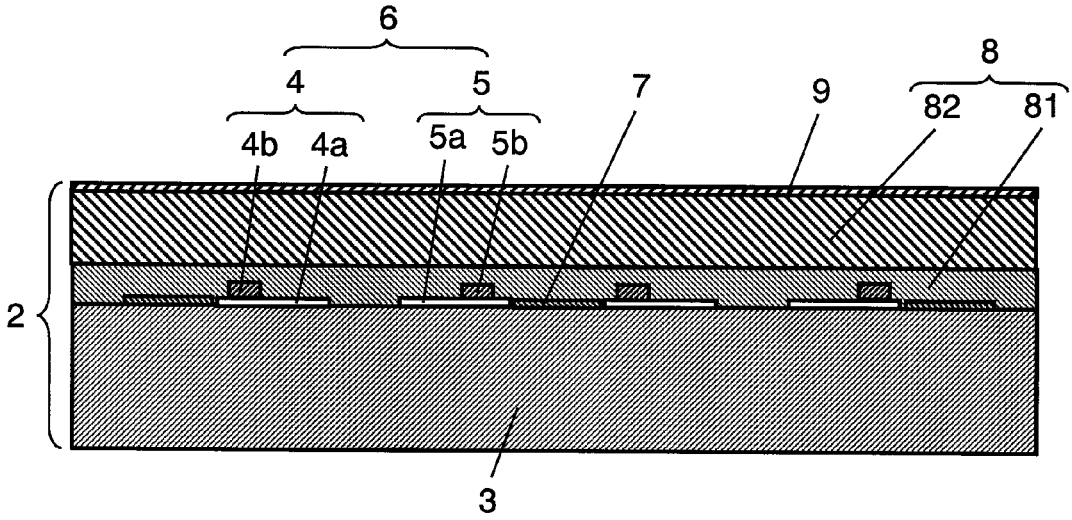
FIG. 2 is a cross-sectional view illustrating the configuration of a dielectric layer in the PDP according to the embodiment of the invention.

FIG. 2 is a cross-sectional view of the front plate 2 illustrating the configuration of dielectric layer 8 in PDP 1 according to the embodiment of the invention. FIG. 2 is an upside-down view of FIG. 1. As shown in FIG. 2, display electrode 6 including scan electrode 4 and sustain electrode 5 and black stripe 7 are pattern-formed on front glass substrate 3 manufactured by using a float method or the like . Scan electrode 4 includes transparent electrode 4*a*, which is made of indium tin oxide (ITO), tin oxide ($SnO_2$), or the like, and metal bus electrode 4*b* formed on transparent electrode 4*a*, and sustain electrode 5 includes transparent electrode 5*a*, which is made of indium tin oxide (ITO), tin oxide ($SnO_2$), or the like, and metal bus electrode 5*b* formed on transparent electrode 5*a*. Metal bus electrodes 4*b* and 5*b* are used to give the conductivity in the longitudinal direction of transparent electrodes 4*a* and 5*a* and formed using a conductive material having a silver material as a main component.

Dielectric layer 8 has a two-layered structure including first dielectric layer 81, which is provided to cover transparent electrodes 4*a* and 5*a*, metal bus electrodes 4*b* and 5*b*, and black stripes 7 formed on front glass substrate 3, and second dielectric layer 82 formed on first dielectric layer 81. In addition, protective layer 9 is formed on second dielectric layer 82.

Next, a method of manufacturing PDP 1 will be described. First, scan electrodes 4, sustain electrodes 5, and light shielding layer 7 are formed on front glass substrate 3. These transparent electrodes 4*a* and 5*a* and metal bus electrodes 4*b* and 5*b* are formed by patterning using a photolithographic method or the like. Transparent electrodes 4*a* and 5*a* are formed using a thin film process and the like, and metal bus electrodes 4*b* and 5*b* are formed by baking paste containing a silver material at the desired temperature and then solidifying the baked paste . In addition, similarly, light shielding layer 7 is also formed using a method of screen-printing a paste containing black pigment or by forming black pigment on the entire surface of glass substrate 3, patterning the pigment using a photolithographic method, and then baking the patterned pigment.

Thereafter, dielectric paste is coated on front glass substrate 3 so as to cover scan electrodes 4, sustain electrodes 5 and light shielding layer 7 using a die coat method, for example , thereby forming a dielectric paste layer (dielectric material layer). By performing no processing for a predetermined period of time after coating the dielectric paste, a surface of the coated dielectric paste is leveled to become a flat surface. Then, dielectric layer 8 that covers scan electrodes 4, sustain electrodes 5, and shielding layer 7 is formed by baking and solidifying the dielectric paste layer. In addition, the dielectric paste is a coating material containing a dielectric material such as glass powder, a binder, and a solvent. Then, protective layer 9 made of magnesium oxide (MgO) is formed on dielectric layer 8 using a vacuum deposition method. A predetermined structure (scan electrodes 4, sustain electrodes 5, light shielding layer 7, dielectric layer 8, and protective layer 9) is formed on front glass substrate 3 through the processes described above, and thus front plate 2 is completed.

On the other hand, rear plate 10 is formed as follows. First, a material layer to become a structure for address electrodes 12 is formed on rear glass substrate 11 by using a method of screen-printing paste containing a silver material or a method in which a metal layer is formed on the entire surface and is then patterned using a photolithographic method, and then the material layer is baked at the predetermined temperature, thereby forming address electrodes 12.

Then, dielectric paste is coated on rear glass substrate 11, on which address electrodes 12 are formed, so as to cover address electrodes 12 using a die coating method, for example, thereby forming a dielectric paste layer. Thereafter, base dielectric layer 13 is formed by baking the dielectric paste layer. In addition, the dielectric paste is a coating material containing a dielectric material such as glass powder, a binder, and a solvent.

Then, a barrier rib material layer is formed by coating barrier ribs forming paste containing a barrier rib material on base dielectric layer 13 and patterning the barrier ribs forming paste in a predetermined shape, and then barrier ribs 14 are formed by baking the patterned barrier ribs. Here, a photolithographic method or a sandblasting method can be used as a method of patterning the paste for barrier ribs coated on base dielectric layer 13.

Then, phosphor paste containing a phosphor material is coated on base dielectric layer 13 between adjacent barrier ribs 14 and side surfaces of barrier ribs 14 and then the coated phosphor paste is baked, thereby forming phosphor layer 15. Through the process described above, rear plate 10 having the predetermined constituent components on rear glass substrate 11 is completed.

Front plate 2 and rear plate 10 having the constituent components as described above are disposed such that scan electrodes 4 and address electrodes 12 are perpendicular to each other, and peripheries of front plate 2 and rear plate 10 are sealed with glass frit, and discharge gas containing neon, xenon, and the like are filled into the discharge space 16, thereby completing PDP 1.

First dielectric layer 81 and second dielectric layer 82 included in dielectric layer 8 of front plate 2 will be described in detail. A dielectric material of first dielectric layer 81 has the following material composition. That is, the dielectric material of first dielectric layer 81 includes 25% to 40% by weight of bismuth oxide ($Bi_2O_3$), 27.5% to 34% by weight of zinc oxide (ZnO), 17% to 36% by weight of boron oxide ($B_2O_3$), 1.4% to 4.2% by weight of silicon oxide ($SiO_2$), and 0.5% to 4.4% by weight of aluminum oxide ($Al_2O_3$). Further, the dielectric material of first dielectric layer 81 includes 5% to 13% by weight of at least one selected from calcium oxide (CaO), strontium oxide (SrO), and barium oxide (BaO) and 0.1% to 7% by weight of at least one selected from molybdenum oxide ($MoO_3$) and tungsten oxide ($WO_3$).

Instead of molybdenum oxide ($MoO_3$) and tungsten oxide ($WO_3$), it may be possible to contain 0.1% to 7% by weight of at least one selected from cerium oxide ($CeO_2$), copper oxide (CuO), manganese dioxide ($MnO_2$), chrome oxide ($Cr_2O_3$), cobalt oxide ($CO_2O_3$), vanadium oxide ($V_2O_7$), and antimony oxide ($Sb_2O_3$).

The dielectric material having the composition described above is ground using a wet jet mill or a ball mill such that an average particle diameter is 0.5 μm to 2.5 μm, thereby forming dielectric material powder. Then, 55% to 70% by weight of the dielectric material powder and 30% to 45% by weight of a binder component are sufficiently kneaded using three rolls so as to generate first dielectric layer paste for die coating or printing . The binder component is ethyl cellulose, terpineol containing 1% to 20% by weight of acrylic resin, or butylcarbitolacetate. In addition, if necessary to improve the print quality, dioctyl phthalate, dibutyl phthalate, triphenyl phosphate, and tributyl phosphate may be added as a plasticizer in the paste and glycerol monooleate, sorbitan seskioleate, Homogenol (registered trademark of Kao Corp.), alkyl allylic phosphate, and the like may be added as a dispersant in the paste.

Thereafter, the first dielectric layer paste is printed on front glass substrate 3 using a die coat method or a screen printing method so as to cover display electrodes 6 and is then dried. Then, the first dielectric layer paste is baked at the temperature of 575° C. to 590° C. slightly higher than the softening point of the dielectric material.

Next, second dielectric layer 82 will be described. A dielectric material of second dielectric layer 82 has the following material composition. That is, the dielectric material of second dielectric layer 82 includes 11% to 20% by weight of bismuth oxide ($Bi_2O_3$), 26.1% to 39.3% by weight of zinc oxide (ZnO), 23% to 32.2% by weight of boron oxide ($B_2O_3$), 1.0% to 3.8% by weight of silicon oxide ($SiO_2$), and 0.1% to 10.2% by weight of aluminum oxide ($Al_2O_3$). Further, the dielectric material of second dielectric layer 82 includes 9.7% to 29.4% by weight of at least one selected from calcium oxide (CaO), strontium oxide (SrO), and barium oxide (BaO) and 0.1% to 5% by weight of cerium oxide ($CeO_2$).

The dielectric material having the composition described above is ground using a wet jet mill or a ball mill such that an average particle diameter is 0.5 μm to 2.5 μm, thereby forming dielectric material powder. Then, 55% to 70% by weight of the dielectric material powder and 30% to 45% by weight of a binder component are sufficiently kneaded using three rolls so as to generate second dielectric layer paste for die coating or printing. The binder component is ethyl cellulose, terpineol containing 1% to 20% by weight of acrylic resin, or butylcarbitolacetate. In addition, if necessary to improve the print quality, dioctyl phthalate, dibutyl phthalate, triphenyl phosphate, and tributyl phosphate may be added as a plasticizer in the paste and glycerol monooleate, sorbitan seskioleate, Homogenol (registered trademark of Kao Corp.), alkyl allylic phosphate, and the like may be added as a dispersant in the paste.

Thereafter, the second dielectric layer paste is printed on first dielectric layer 81 using the screen printing method or the die coat method and is then dried. Then, the second dielectric layer paste is baked at the temperature of 550° C. to 590° C. slightly higher than the softening point of the dielectric material.

Here, as for the thickness of dielectric layer 8, the thickness of both first dielectric layer 81 and second dielectric layer 82 is preferably 41 μm or less in order to secure visible light transmittance. In order to inhibit reaction with silver (Ag) of metal bus electrodes 4*b* and 5*b*, the bismuth oxide content of first dielectric layer 81 is set to 25% to 40% by weight, which is higher than the bismuth oxide content of second dielectric layer 82. Accordingly, the visible light transmittance of first dielectric layer 81 becomes lower than that of second dielectric layer 82. For this reason, the film thickness of first dielectric layer 81 is made thinner than that of second dielectric layer 82.

Moreover, when the bismuth oxide ($Bi_2O_3$) content of second dielectric layer 82 is 11% or less by weight, the visible light transmittance is not easily reduced, but is not preferable because bubbles easily occur in second dielectric layer 82. In addition, when the bismuth oxide ($Bi_2O_3$) content of second dielectric layer 82 is larger than 20% by weight, it is not preferable for the purpose of increase in the visible light transmittance.

Further, as the thickness of dielectric layer 8 becomes small, an effect in which the panel brightness is improved and a discharge voltage is reduced becomes noticeable. However, if the film thickness of dielectric layer 8 is two small, it is not possible to acquire a required withstand voltage for insulation. From the above point of view, in the embodiment of the invention, the film thickness of dielectric layer 8 is set to 41 μm or less such that first dielectric layer 81 has a thickness of 5 μm to 13 μm and second dielectric layer 82 has the thickness of is 28 μm to 36 μm.

Thus, in order to inhibit reaction with silver of metal bus electrodes 4*b* and 5*b*, it is necessary to properly set the bismuth oxide content of first dielectric layer 81 that covers metal bus electrodes 4*b* and 5*b*. That is, if the amount of bismuth oxide with respect to silver electrodes decreases, the effect that the bismuth oxide inhibits the reaction with the silver electrodes is also reduced. In contrast, if the amount of bismuth oxide with respect to the silver electrodes increases, it is difficult that bubbles generated due to silver oxide, which is formed because the bismuth oxide is reduced by the silver electrodes and alkali metal ions contained in dielectric layer 8, escape from first dielectric layer 81, resulting in a cause of poor insulation.

Figure 3:
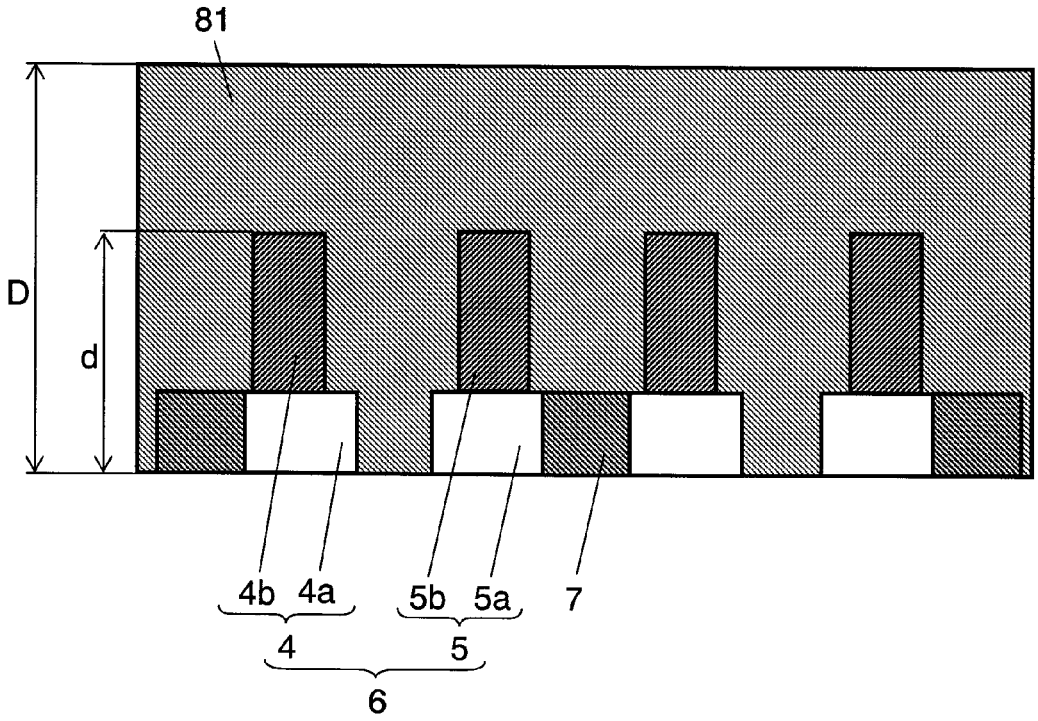
FIG. 3 is an enlarged sectional view illustrating a first dielectric layer in the PDP according to the embodiment of the invention.

FIG. 3 is an enlarged sectional view illustrating first dielectric layer 81 in the embodiment of the invention. As shown in FIG. 3, the proper amount of bismuth oxide with respect to silver electrodes was examined while changing the ratio between thickness D of first dielectric layer 81 and thickness d of display electrode 6 having metal bus electrodes 4*b* and 5*b* that are silver electrodes. Here, 'D' is equal to or larger than 5 μm and equal to or smaller than 13 μm. If 'D' is smaller than 5 μm, it is not possible to inhibit the reaction with silver (Ag) of metal bus electrodes 4*b* and 5*b*. In addition, if 'D' exceeds 13 μm, the visible light transmittance decreases. As a result, it was found that the ratio of the thickness of first dielectric layer 81 to the thickness of display electrodes 6 was preferably larger than 1 and equal to or smaller than 3. That is, since it is necessary that first dielectric layer 81 cover at least display electrodes 6, the ratio of the thickness of first dielectric layer 81 to the thickness of display electrodes 6 needs to be larger than 1. In addition, if the ratio exceeds 3, it is difficult that bubbles generated due to silver oxide escape from first dielectric layer 81.

Next, in PDP 1 according to the embodiment of the invention, it will be considered how coloring and generation of bubbles in first dielectric layer 81 are inhibited by these dielectric materials. That is, it is known that compounds, such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$ are easily generated at the low temperature of 580° C. or less if molybdenum oxide ($MoO_3$) or tungsten oxide ($WO_3$) is added in a dielectrics glass material containing bismuth oxide ($Bi_2O_3$). In the embodiment of the invention, since the baking temperature of dielectric layer 8 is 550° C. to 590° C., Ag ions ($Ag^+$) diffused in dielectric layer 8 during the baking react with molybdenum oxide ($MoO_3$) and tungsten oxide ($WO_3$) in dielectric layer 8 to generate a stable compound, thereby being stabilized. That is, since the Ag ions ($Ag^+$) are stabilized without being reduced, the Ag ions ($Ag^+$) are not aggregated to generate a colloid. Therefore, generation of oxygen due to colloidalization of Ag decreases as the Ag ions ($Ag^+$) are stabilized. As a result, generation of bubbles in dielectric layer 8 also decreases.

On the other hand, in order to make the above effects effective, preferably, the content of molybdenum oxide ($MoO_3$) or tungsten oxide ($WO_3$) in a dielectrics glass material containing bismuth oxide ($Bi_2O_3$) is 0.1% by weight or more, and more preferably, 0.1% by weight or more and 7% by weight or less. In particular, an effect of inhibiting coloring is weak at 0.1% by weight or less, and coloring occurs in the dielectrics glass material at 7% by weight or more, which is not desirable.

As described above, according to the PDP according to the embodiment of the invention, it is possible to realize a PDP having a dielectric layer, of which visible light transmittance is high and insulation performance is high and in which a lead component is not contained, in consideration of an environmental issue.

INDUSTRIAL APPLICABILITY

The PDP of the invention is effective for a large-screen display device or the like since the PDP, in which generation of bubbles in a dielectric layer is reduced and generated bubbles easily escape from the dielectric layer such that poor insulation does not occur, is realized.

The invention claimed is:

1. A plasma display panel comprising:

a front plate having display electrodes, a dielectric layer, and a protective layer formed on a glass substrate; and a rear plate that has electrodes, barrier ribs, and a phosphor layer formed on a substrate and is disposed opposite to the front plate, wherein peripheries of the front plate and the rear plate are sealed to form a discharge space, the display electrodes contains at least silver, the dielectric layer is configured to include a first dielectric layer that covers the display electrodes and contains bismuth oxide, and a second dielectric layer that covers the first dielectric layer and contains bismuth oxide, wherein the first dielectric layer contains 25% to 40% by weight of bismuth oxide, the thickness of the first dielectric layer is equal to or larger than 5 μm and equal to or smaller than 13 μm, and the ratio of the thickness of the first dielectric layer to the thickness of the display electrodes is larger than 1 and equal to or smaller than 3.

2. The plasma display panel of claim 1, wherein the content of bismuth oxide of the second dielectric layer is smaller than the content of bismuth oxide of the first dielectric layer.

3. The plasma display panel of claim 2, wherein the first dielectric layer contains 0.1% by weight or more and 7% by weight or less of at least one of molybdenum oxide and tungsten oxide.

4. The plasma display panel of claim 3, wherein the first dielectric layer and the second dielectric layer contain at least one of zinc oxide, boron oxide, silicon oxide, at least one of zinc oxide, calcium oxide, strontium oxide, and barium oxide.

5. The plasma display panel of claim 2, wherein the second dielectric layer contains 11% by weight or more and 20% by weight or less of bismuth oxide.

6. The plasma display panel of claim 5, wherein the first dielectric layer and the second dielectric layer contain at least one of zinc oxide, boron oxide, silicon oxide, aluminum oxide, calcium oxide, strontium oxide, and barium oxide.

7. The plasma display panel of claim 2, wherein the first dielectric layer and the second dielectric layer contain at least one of zinc oxide, boron oxide, silicon oxide, aluminum, oxide, calcium oxide, strontium oxide, and barium oxide.

* * * * *